US005902926A

United States Patent [19]

Davis

[11] Patent Number: 5,902,926

[45] Date of Patent: May 11, 1999

[54] METHOD TO IDENTIFY GAS COMBUSTION INTEGRITY IN FAN ASSISTED EQUIPMENT

[76] Inventor: Thomas G. Davis, 224 Navajo, Council Bluffs, Iowa 51501

[21] Appl. No.: 08/899,201

[22] Filed: Jul. 23, 1997

[51] Int. Cl.[6] ..... F23N 5/00

[52] U.S. Cl. ..... 73/23.31; 431/76

[58] Field of Search ..... 73/23.31, 31.03; 431/14, 76

[56] References Cited

U.S. PATENT DOCUMENTS 3,288,199 11/1966 Gerrard et al. ..... 431/76
4,260,363 4/1981 Cratin, Jr. ..... 431/76
4,622,004 11/1986 Dalhuisen ..... 431/76
4,638,789 1/1987 Ueki et al. ..... 431/76
5,160,259 11/1992 O'Hara et al. ..... 431/76

*Primary Examiner*—Michael Brock
*Attorney, Agent, or Firm*—Zarley, McKee, Thomte, Voorhees & Sease

[57] ABSTRACT

The method of invention involves the steps of placing a small hole in the flue of a furnace or the like; inserting the elongated probe of a CO tester in the hole; visually ascertain from the tester the CO content of the gas in the flue, comparing the measured CO content of the gas in the flue against a predetermined perimeter range of CO content between 0–45 ppm for furnaces, and 0–85 ppm for hot water boilers to determine the cleanliness of the combustible materials in the gas being combusted, and resealing the hole in the flue.

11 Claims, 1 Drawing Sheet

METHOD TO IDENTIFY GAS COMBUSTION INTEGRITY IN FAN ASSISTED EQUIPMENT

BACKGROUND OF THE INVENTION

The combustion integrity of the flame to identify clean combustion in gas burning equipment in residential, commercial and light industrial facilities has heretofore been conducted by visual inspection of the flame. A qualified technician could make a visual observation of the flame and the residue left at the draft divertor, and some judgment could then reasonably be made as to the quality of the flame. Other than visual inspection, there has not been any equipment or special procedures to test for complete and clean combustion, particularly at levels to identify subtle problems that could be corrected inexpensively.

The Energy Conservation Act of 1987 required that all new equipment involving combustion must be fan assisted. In recent years, it has become apparent that a visual check by a technician of the flame was not good enough when fan assisted combustion was involved. Fan assisted combustion can be in the form of induced draft, or forced draft. Technicians have been missing or misdiagnosing many combustion problems because of reliance on visual identification. Sometimes with fan assisted combustion, the flame cannot be seen or cannot be easily seen. In many cases there is not even a small peep hole available for examination of the flame.

Sampling the flue for $O_2$ or $CO_2$ is not the answer to the foregoing problem because oxygen deficiency due to low combustion air flow is not one of the most common causes of poor combustion. In the majority of combustion problems, there is sufficient $O_2$ left in the flue products. Thus, conventional equipment for sampling gases within the flue could not solve the problem.

When there is a problem in the combustion process, the CO levels increase. It doesn't matter if the source of the problem is oxygen deficiency, poor primary air entrainment, or flame impingement. Measuring CO levels may indicate the existence of a problem, but CO levels do not identify specific problems and it is not known within the industry what levels of CO signify trouble.

It is, therefore, a principal object of this invention to provide a method to identify the combustion integrity in fan assisted equipment.

A further object of this invention is to provide a method to identify combustion integrity of fan assisted equipment which can be easily and quickly practiced, and which can be economically conducted with existing equipment.

These and other objects will be apparent to those skilled in the art.

SUMMARY OF THE INVENTION

The method of invention involves the steps of placing a small hole in the flue of a furnace or the like; inserting the elongated probe of a CO tester in the hole; visually ascertain from the tester the CO content of the gas in the flue, comparing the measured CO content of the gas in the flue against a predetermined perimeter range of CO content for furnaces between 0 and 45 ppm; and 0–85 ppm, for boilers to determine the cleanliness and complete combustion of the combustible materials in the gas being combusted, and resealing the hole in the flue.

DESCRIPTION OF THE PREFERRED EMBODIMENT

Figure 1:
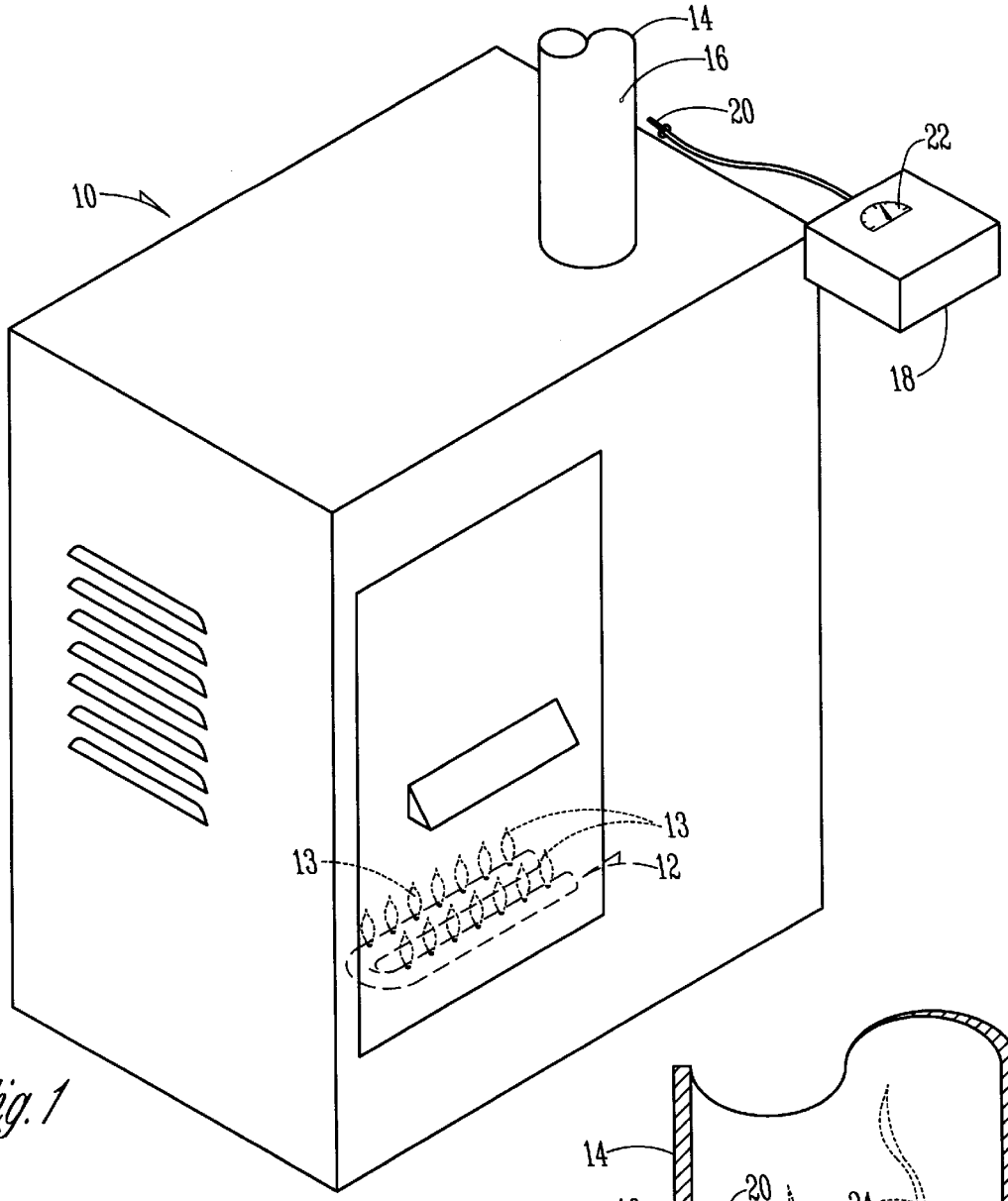
FIG. 1 is a perspective view of a fan assisted combustion furnace.

A furnace 10 is shown in FIG. 1 which has a conventional burner 12 which is connected to a source of natural gas or the like (not shown). The numeral 13 designates a plurality of flames emitted from burner 12.

A conventional flue 14 is conventionally connected to the area of burner 12 so that the gases of combustion can conventionally exit the furnace. The conventional fan structure in the furnace has not been shown.

Figure 2:
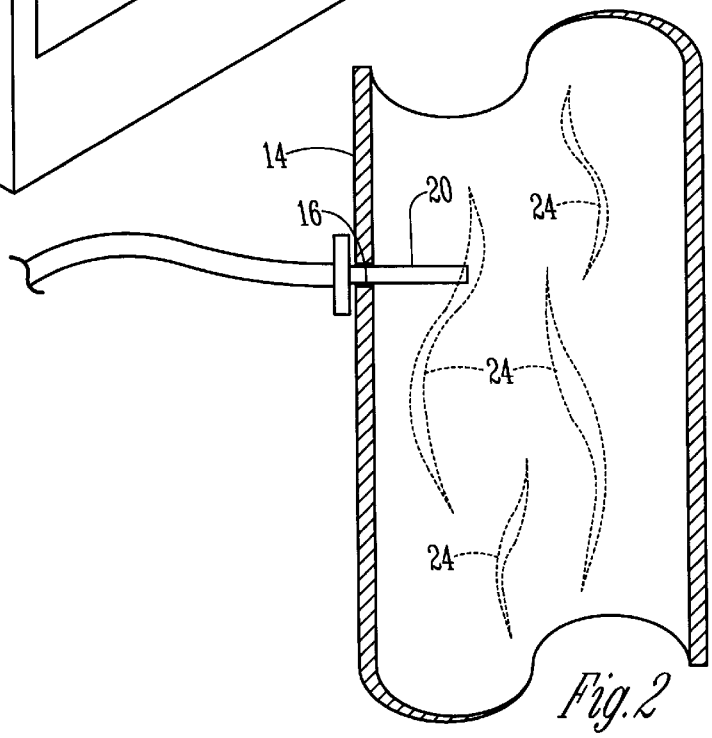
FIG. 2 is an enlarged scale sectional view of the gases in the flue of the furnace of FIG. 1 being tested for CO.

The numeral 16 designates an aperture in flue 14 which will be discussed hereafter. The numeral 18 designates a conventional CO tester having an elongated probe 20 and read-out dial 22. In FIG. 2, the gases of combustion are designated by the numeral 24. To test the furnace 10 for its combustion integrity, the technician drills a small hole 16 in flue 14 sufficiently large so that the hole can receive the probe 20 of CO tester 18. By so doing, the conventional tester 18 will reflect on dial 22 in ppm's the CO content in the gases of combustion 24. Testers 18 have been in existence and have been used for this purpose for many years.

Central to this invention is the discovery that if the CO content of the combustion gases or fumes fall above a certain range, the integrity of the combustion is at fault and corrective steps need to be taken. Extensive laboratory testing in the field reveal that when the CO content in the flue is measured in the range of over 45–110 ppm, defective combustion is taking place. Specifically in hot air furnaces after a warm-up period of 8 to 10 minutes, a CO content in the flue of 45 ppm or less will indicate healthy (clean, complete) combustion. Similarly, for boilers and water heaters after the water has reached its median operating temperature, a CO level in the gases of combustion at approximately 85 ppm or above will indicate faulty combustion. The median operating temperature of the water should be at its midpoint between burner off and burner on, e.g., off at 180° F. and on at 120° F. with the median being 150° F. At any time that the CO is below the above levels, for the specified equipment, the combustion process is in good condition, and no other tests need to be made. The CO readings at or below the foregoing levels will maintain clean combustion for thousands of hours of equipment operation. Higher numbers will continue to get worse, sometimes at a rapid rate.

The above numbers are valid for a wide range of equipment regardless of the manufacture. The numbers are valid for Bunsen-type burners where primary air and the secondary air have separate paths of flow. They are also valid for pulse combustion and one port radiant burners that have primary and secondary fuel and excess air, all taking the same path through the burner.

Testing has proven that there is no need to convert these numbers to an air free basis, that is, testing for the $O_2$ left in the flue sample and thereupon calculating a higher value for the CO. CO is an unstable gas in the presence of adequate supplies of oxygen, and will quickly convert to $CO_2$. This is accomplished by the CO attaching to the oxygen atom. Thus, the above-described flue test is to identify healthy combustion by taking only a sample of CO since the oxygen or air free readings have very little except for equipment that has higher than the industry norm for excess air. The standard amount of excess air has already been taken into account for the above numbers. Pulse combustion or one port radiant burners by necessity have very low amounts of excess oxygen in their flue streams.

After the technician has taken the CO level, read the dial 22, and compared it with the above-designated ranges of CO content, the aperture 16 is sealed. If the CO content in the flue is below the above-described numbers, nothing further needs to be done. If the CO content exceeds the above numbers, the equipment must be repaired to prevent its ultimate deterioration.

The following is a partial list of causes for elevated CO readings: Oxygen deficiency problems:

Caused by partially plugged vent, air intake, or combustion chamber.

bad pressure switch in conjunction with one of the other problems dirty/defective blower wheel partially plugged condensate drain low voltage to inducer motor insufficient combustion air provided to equipment space exhaust fans, fireplaces running wind direction/velocity effecting vent action. Air entrainment problems:

caused by rust, bugs, dirt, in burners poor alignment or placement of burners warped or damaged burners wrong orifice size, wrong input wrong manifold pressure too much primary air (lifting flames)

baffles or restrictors missing or out of place in the heat exchanger/s Impingement problems (flame quenching):

Equipment loaded too heavily (high GPM/CFM)

burner warped or out of place damaged heat exchanger (warped, cracked, holes) Holes in the heat exchange:

this is the one problem that may/may not express itself in elevated CO readings, the location of the hole seems to be the determining factor in whether the combustion process is effected. If a compromised heat exchange is suspected use the approved methods of proving/disproving the existence of a hole.

If the technician has access to oxygen sampling equipment, the taking of $O_2$ sample where the high CO reading was just taken will let the technician know if the problem is one of "Oxygen deficiency" or one of the other categories (air entrainment, impingement or hole in the heat exchanger).

The CO sample reading will also let the technician know if a perceived pressure switch problem is real or the pressure switch is at fault. If the pressure switch fails to close, the technician can install a temporary jumper wire which will bring on the burner. If there is partial blockage or insufficient air for combustion this will be evidenced in the form of an elevated CO reading. If the CO is within the normal range, the switch itself is bad. This same test can be performed with an $O_2$ meter.

Samples of the flue can be taken any place that is upstream of any possible dilution air getting into the vent. Vent systems that maintain a positive pressure all the way to the termination can even be sampled at the termination.

The CO sampling device 18 should have a conventional pump to insure that a known sample size is being evaluated. Test devices that utilize natural sample flow or aspirator bulbs are not reliable enough to provide the accurate readings that can define the subtle differences between healthy and problematic combustion. The table below reflects the desired parameters to be followed practicing this invention.

| CLEAN COMBUSTION | MARGINAL COMBUSTION (MIGHT GET WORSE) | PROBLEMATIC COMBUSTION (WILL GET WORSE) |
|---|---|---|
| Hot Air | Hot Air | Hot Air |
| 0–45 | 45–70 | 70–up |
| Boilers | Boilers | Boilers |
| 0–85 | 85–110 | 110–up |

It is, therefore, seen that the method of this invention will permit the measured level of CO in the flue to immediately be interpreted as to the cause therefor. If the CO levels are below the figures presented heretofore, the technician will know that the combustion of the fuel is satisfactory and that even if other problems are found to exist, the matter of faulty combustion can be eliminated as the source of the problem. The objects of this invention are therefore seen to be met.

What is claimed is:

1. A method of identifying the cleanliness of gas combustion in fan assisted equipment having a flame burner connected to a source of combustible gas and a flue for discharging the gas products of combustion, comprising, creating a small opening in the flue while gas is being combusted at said burner, placing a probe from a CO tester through said opening with said probe being connected to a read-out indicator on said tester outside said flue, reading from said tester the CO content in ppm's of the gases passing through said flue, and determining whether said read CO content falls above 45 ppm when said equipment is a furnace.

2. The method of claim 1 comprising the additional step of adjusting the gas combustion at said burner to move within the range of 0–45 if said read CO content exceeds 45 ppm.

3. The method of claim 1 comprising the additional step of removing said probe from said opening and closing said opening.

4. The method of claim 1 comprising the additional step of removing said probe from said opening and closing and sealing said opening.

5. A method of identifying the cleanliness of gas combustion in fan assisted equipment having a flame burner connected to a source of combustible gas and a flue for discharging the gas products of combustion, comprising, creating a small opening in the flue while gas is being combusted at said burner, placing a probe from a CO tester through said opening with said probe being connected to a read-out indicator on said tester outside said flue, reading from said tester the CO content in ppm's of the gases passing through said flue, and determining whether said read CO content falls above 85 ppm when said equipment is a hot water boiler.

6. The method of claim 2 comprising the additional step of adjusting the gas combustion at said burner to move within the range of 0–85 if said read CO content exceeds 85 ppm.

7. The method of claim 2 comprising the additional step of removing said probe from said opening and closing said opening.

8. The method of claim 2 comprising the additional step of removing said probe from said opening and closing and sealing said opening.

9. A method of identifying gas combustion integrity in fan assisted equipment having a flame burner connected to a source of combustible gas and a flue for discharging the gas products of combustion, comprising, measuring the CO content in said flue to determine if the CO content in said flue exceeds 110 ppm, and adjusting the gas combustion at said burner to move within the range of 0–85 ppm if said read CO content exceeds 110 ppm.

10. A method of identifying the cleanliness of gas combustion in fan assisted gas fired furnaces having a flame burner connected to a source of combustible gas and a flue for discharging the gas products of combustion, comprising, measuring the CO content in said flue to determine if the CO contact in said flue exceeds 45 ppm, and adjusting the gas combustion at said burner to move to levels of 45 ppm or less if said read CO content exceeds 45 ppm.

11. A method of identifying the cleanliness of gas combustion in fan assisted gas fired water heaters having a flame burner connected to a source of combustible gas and a flue for discharging the gas products of combustion, comprising, measuring the CO content in said flue to determine if the CO contact in said flue exceeds 85 ppm, and adjusting the gas combustion at said burner to move to levels of 85 ppm or less if said read CO content exceeds 85 ppm.

* * * * *

UNITED STATES PATENT AND TRADEMARK OFFICE

CERTIFICATE OF CORRECTION

PATENT NO. : 5,902,926

DATED : May 11, 1999

INVENTOR(S) : Thomas G. Davis

It is certified that error appears in the above-identified patent and that said Letters Patent are hereby corrected as shown below:

Claim 6, line 1, strike the numeral "2" and insert the numeral - 5 -.

Claim 7, line 1, strike the numeral "2" and insert the numeral - 5 -.

Claim 8, line 1, strike the numeral "2" and insert the numeral - 5 -.

Signed and Sealed this

Twelfth Day of October, 1999

*Attest:*

Q. TODD DICKINSON

*Attesting Officer*

*Acting Commissioner of Patents and Trademarks*